US009049895B1

(12) United States Patent
Wesol et al.

(10) Patent No.: US 9,049,895 B1
(45) Date of Patent: Jun. 9, 2015

(54) SHIRT STAY WITH IMPROVED FASTENER AND ASSOCIATED USE THEREOF

(71) Applicants: Gerald A. Wesol, Casselberry, FL (US); David H. Little, Winter Park, FL (US)

(72) Inventors: Gerald A. Wesol, Casselberry, FL (US); David H. Little, Winter Park, FL (US)

( * ) Notice: Subject to any disclaimer, the term of this patent is extended or adjusted under 35 U.S.C. 154(b) by 0 days.

(21) Appl. No.: 14/214,281

(22) Filed: Mar. 14, 2014

Related U.S. Application Data

(60) Provisional application No. 61/781,145, filed on Mar. 14, 2013.

(51) Int. Cl.

| | |
|---|---|
| ***A41F 17/00*** | (2006.01) |
| ***A41F 5/00*** | (2006.01) |
| *A41F 19/00* | (2006.01) |
| *A41F 11/16* | (2006.01) |

(52) U.S. Cl.
CPC . *A41F 17/00* (2013.01); *A41F 5/00* (2013.01); *A41F 11/16* (2013.01); *A41F 19/00* (2013.01)

(58) Field of Classification Search
CPC ..... A41F 5/00; A41F 17/00; A41F 11/02; A41F 11/16; A41F 19/00; A41F 3/02; A41F 11/14; A41F 15/02
See application file for complete search history.

(56) References Cited

U.S. PATENT DOCUMENTS

| | | | | | |
|---|---|---|---|---|---|
| 311,111 | A * | 1/1885 | Eisler | 2/326 |
| 755,188 | A * | 3/1904 | Tooker | 2/300 |
| 770,761 | A * | 9/1904 | Lemly | 224/649 |
| 863,970 | A * | 8/1907 | Ebersole | 2/326 |
| 1,334,514 | A * | 3/1920 | Beitter | 2/327 |
| 1,335,927 | A * | 4/1920 | Ainsworth | 2/310 |
| 1,392,935 | A * | 10/1921 | Glickman | 2/326 |
| 1,398,962 | A * | 12/1921 | Graves | 2/331 |
| 1,446,948 | A * | 2/1923 | Taylor | 2/117 |
| 1,653,288 | A * | 12/1927 | Johnson | 2/326 |
| 1,839,143 | A * | 12/1931 | Ellis | 2/305 |
| 1,852,030 | A * | 4/1932 | Shipman | 2/327 |
| 1,983,636 | A * | 12/1934 | Palkens | 450/113 |
| 2,133,505 | A * | 10/1938 | Green | 2/106 |
| 2,440,982 | A * | 5/1948 | Speller et al. | 2/305 |
| 2,682,669 | A * | 7/1954 | Valentine et al. | 2/310 |
| 2,727,247 | A * | 12/1955 | Bailey | 2/323 |
| 3,052,891 | A * | 9/1962 | Panepinto | 2/301 |
| 3,167,786 | A * | 2/1965 | Johnson | 2/327 |
| 3,401,857 | A * | 9/1968 | Wilson et al. | 224/637 |
| 3,501,774 | A * | 3/1970 | Norman | 2/321 |
| 4,481,682 | A * | 11/1984 | Hall | 2/326 |
| 4,596,569 | A * | 6/1986 | Campbell | 604/387 |
| 4,853,979 | A * | 8/1989 | Ryder | 2/326 |
| 4,937,886 | A * | 7/1990 | Ellis | 2/323 |
| 5,177,814 | A * | 1/1993 | Courtney | 2/326 |
| 5,276,923 | A * | 1/1994 | Cohen | 2/323 |
| 5,488,738 | A * | 2/1996 | Seamans | 2/69 |
| 5,884,371 | A * | 3/1999 | Huggins | 24/300 |
| 6,125,475 | A * | 10/2000 | Taylor | 2/333 |
| 6,167,573 | B1 * | 1/2001 | Lewis | 2/327 |

(Continued)

*Primary Examiner* — Bobby Muromoto, Jr.

(57) ABSTRACT

A shirt stay garter employs a releasable fastening clip for reducing a tendency for plastic and/or clam-type button clips to fail (e.g., come loose). Use of the improved fastener provides a center pin that keeps the shirt stay device from coming loose. The shirt stay garter may be embodied in a variety of forms including a stirrup style, a 4-strap style, and a Y-style, for example. The shirt stay garter may include a distal member adapted to be engaged with a support surface, a proximal member slidably coupled to the distal member, and a fastener attached to the proximal member. Notably, the fastener is adapted to engage the shirt tail and resists external forces acting thereagainst during extended periods of time.

11 Claims, 8 Drawing Sheets

(56) References Cited

U.S. PATENT DOCUMENTS

| | | | | |
|---|---|---|---|---|
| D581,633 | S * | 12/2008 | Seibold | D2/841 |
| 7,891,023 | B1 * | 2/2011 | Hill | 2/310 |
| 8,209,779 | B2 * | 7/2012 | Herman | 2/327 |
| 8,429,773 | B2 * | 4/2013 | Herman | 5/498 |
| D692,638 | S * | 11/2013 | Herman | D2/626 |
| D712,306 | S * | 9/2014 | Fildan et al. | D11/218 |
| 2002/0112275 | A1 * | 8/2002 | Hall | 2/310 |
| 2006/0185056 | A1 * | 8/2006 | Zwick | 2/115 |
| 2009/0070915 | A1 * | 3/2009 | Hill | 2/117 |
| 2011/0167540 | A1 * | 7/2011 | Little | 2/312 |
| 2011/0197335 | A1 * | 8/2011 | Handy | 2/117 |
| 2013/0247280 | A1 * | 9/2013 | Haggard | 2/256 |

* cited by examiner

SHIRT STAY WITH IMPROVED FASTENER AND ASSOCIATED USE THEREOF

CROSS REFERENCE TO RELATED APPLICATIONS

This application claims the benefit of U.S. Provisional Application No. 61/781,145 filed Mar. 14, 2013, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

1. Technical Field

Exemplary embodiment(s) of the present disclosure relate to shirts stays and, more particularly, to a shirt stay garter employing a releasable fastening clip of the type described in U.S. Pat. Nos. D614,946 and 8,209,779 for reducing a tendency for plastic and/or clam-type button clips to fail (e.g., come loose).

2. Prior Art

Shirt stay devices are well-known, particularly for the pervasive use within the military services. They provide a method to promote the appearance of a squarely tucked and fitted wrinkle free shirt from both front and back views. These devices generally are used to constantly avoid tucking and re-tucking one's shirt into one's pants. Indeed, military appearance is a characteristic trait that is observed, graded and considered during promotion reviews in all services. Accordingly, use of shirt stays to enhance one's appearance is common.

Several different styles of shirt stays are commercially available. For example, individual four strand and stirrup styles are readily available as accessories sold at military exchanges, outposts or retail facilities where the required uniforms are also available for purchase. The clip ends of these accessories consist of a rubber male lead and female wire receptacle clevis which are designed to fasten together while grasping, clamping and securing a piece of the garment in place between the fasteners. The opposite or lower end of these devices is normally either fastened or secured to the upper region of the wearer's socks, or around the bottom of the heel if they are of the stirrup style. An adjustable clamp is often provided in order to lengthen or shorten the elongated flexible strap to fit the user. However, the clip and clevis attachment method is generally inadequate for firm and prolonged attachment; the upper garment clip ends often become loose or more often, unattached, particularly during moderate or excessive activity of the wearer.

It therefore would be desirable to provide a garment fastening mechanism and method that allows conventional shirt stay or shirt holder devices to fasten together without grasping and gathering garment material and using it as the mooring matter. The exemplary embodiment(s) satisfy such a need by providing shirt stay garter that is convenient and easy to use, lightweight yet durable in design, versatile in its applications, and designed for reducing a tendency for plastic and/or clam-type button clips to fail (e.g., come loose).

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a shirt stay garter for maintaining a shirt tail at a tucked position during use. These and other objects, features, and advantages of the non-limiting exemplary embodiment(s) are provided by a shirt stay garter including an elastic body having a proximal end portion and a distal end portion opposed therefrom, a first clip and a second clip pivotally attached to the body, and a bracket slidably spaced from the first clip and the second clip. The bracket is engaged with the body in such a manner that a longitudinal length of the body is selectively adjusted as the bracket is slidably positioned between the proximal end portion and the distal end portion of the body.

In a non-limiting exemplary embodiment, the body includes: a single and unitary first elastic strap having a first end and a second end juxtaposed adjacent thereto in such a manner that the first end and the second end each are located at the proximal end portion of the body, the first clip and the second clip being mated to the first end and the second end, respectively; a coupling statically affixed to an intermediary portion of the first elastic strap and equidistantly spaced from the first clip and the second clip; and a single and unitary second elastic strap slidably engaged with the coupling and located at the distal end portion of the body, the second elastic strap being oppositely disposed from the first clip and the second clip.

In a non-limiting exemplary embodiment, the first elastic strap has a non-looped configuration.

In a non-limiting exemplary embodiment, the second elastic strap has a looped configuration including an adjustable first loop and a fixed second loop attached to the adjustable first loop. In this manner, the bracket is slidably mated to the adjustable first loop and spaced from the fixed second loop in such a manner that a longitudinal length of the first loop is selectively adjusted at a non-tensioned state while a longitudinal length of the second loop remains fixed at a non-tensioned state, respectively.

In a non-limiting exemplary embodiment, the body includes a single and unitary first elastic strap having a first end and a second end juxtaposed adjacent thereto in such a manner that the first end and the second end are located at the proximal end portion of the body wherein the first clip and the second clip are mated to the first end and the second end, respectively. A coupling is statically affixed to an intermediary portion of the first elastic strap and equidistantly spaced from the first clip and the second clip. A single and unitary second elastic strap is slidably engaged with the coupling and located at the distal end portion of the body wherein the second elastic strap is oppositely disposed from the first clip and the second clip.

In a non-limiting exemplary embodiment, the second elastic strap has a looped configuration. In this manner, the bracket is slidably mated to the second elastic strap and spaced from the first elastic strap in such a manner that a longitudinal length of the second elastic strap is selectively adjusted at a non-tensioned state while a longitudinal length of the first elastic strap is fixed at a non-tensioned state;

In a non-limiting exemplary embodiment, a third clip is affixed to the second elastic strap and spaced from the bracket. Such a third clip is oppositely spaced from the first clip and the second clip.

In a non-limiting exemplary embodiment, the body includes a looped portion located at the distal end portion wherein the first clip being statically affixed to the proximal end portion of the bod. In this manner, the second clip is slidably connected to the looped portion and oppositely disposed from the first clip.

The present disclosure further includes a method of utilizing a shirt stay garter for maintaining a shirt tail at a tucked position during use. Such a method includes the steps of: providing an elastic body having a proximal end portion and a distal end portion opposed therefrom; providing and pivotally attaching a first clip and a second clip to the body; providing and slidably engaging a bracket with the body; spacing the bracket from the first clip and the second clip; and selectively adjusting a longitudinal length of the body by slidably positioning the bracket between the proximal end portion and the distal end portion of the body.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
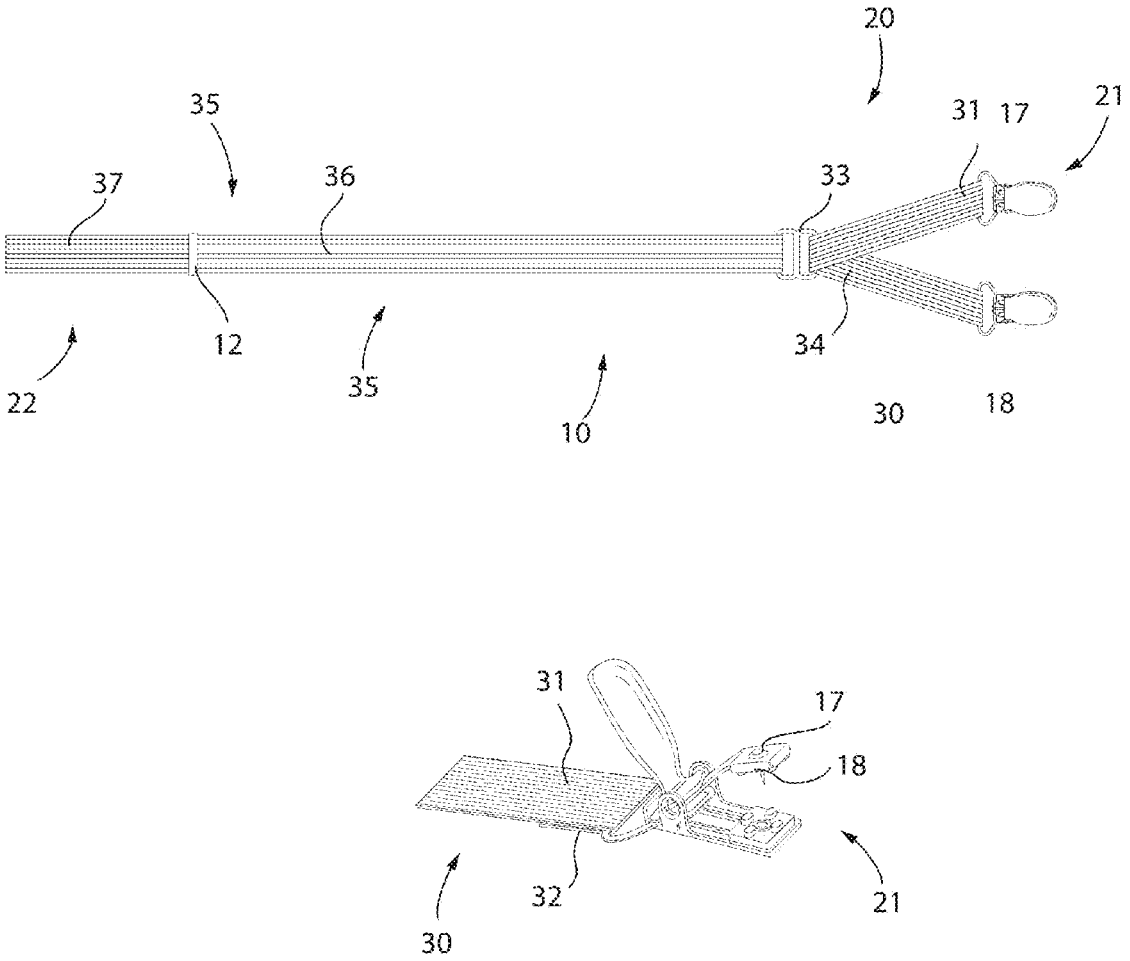
FIG. 1 is a perspective view showing a pair of shirt stay garters, in accordance with a non-limiting exemplary embodiment.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary emboidment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

The non-limiting exemplary embodiment(s) of the present disclosure are referred to generally in FIGS. 1-8 and are intended to provide a shirt stay garter 10, 10', 10" employing releasable clips (e.g., at least 17, 18) for reducing a tendency of plastic and/or clam-type button clips to fail (e.g., come loose). It should be understood that the exemplary embodiments 10, 10', and 10" may be used to maintain many different types of shirt tails at a desired position, and should not be limited to any particular shirt tails described herein.

The shirt stay garter 10, 10', and 10" includes an elastic body 20, 20' and 20" having a proximal end portion 21, 21' and 21" as well as a distal end portion 22 22 and 22" opposed therefrom, a first clip 17 and a second clip 18 pivotally attached to the body 20, 20' and 20" as well as a bracket 12 slidably spaced from the first clip 17 and the second clip 18. The bracket 12 is engaged with the body 20, 20' and 20" in such a manner that a longitudinal length of the body 20, 20' and 20" is selectively adjusted as the bracket 12 is slidably positioned between the proximal end portion 21, 21' and 21" and the distal end portion 22, 22' and 22" of the body 20, 20' and 20".

Figure 2:
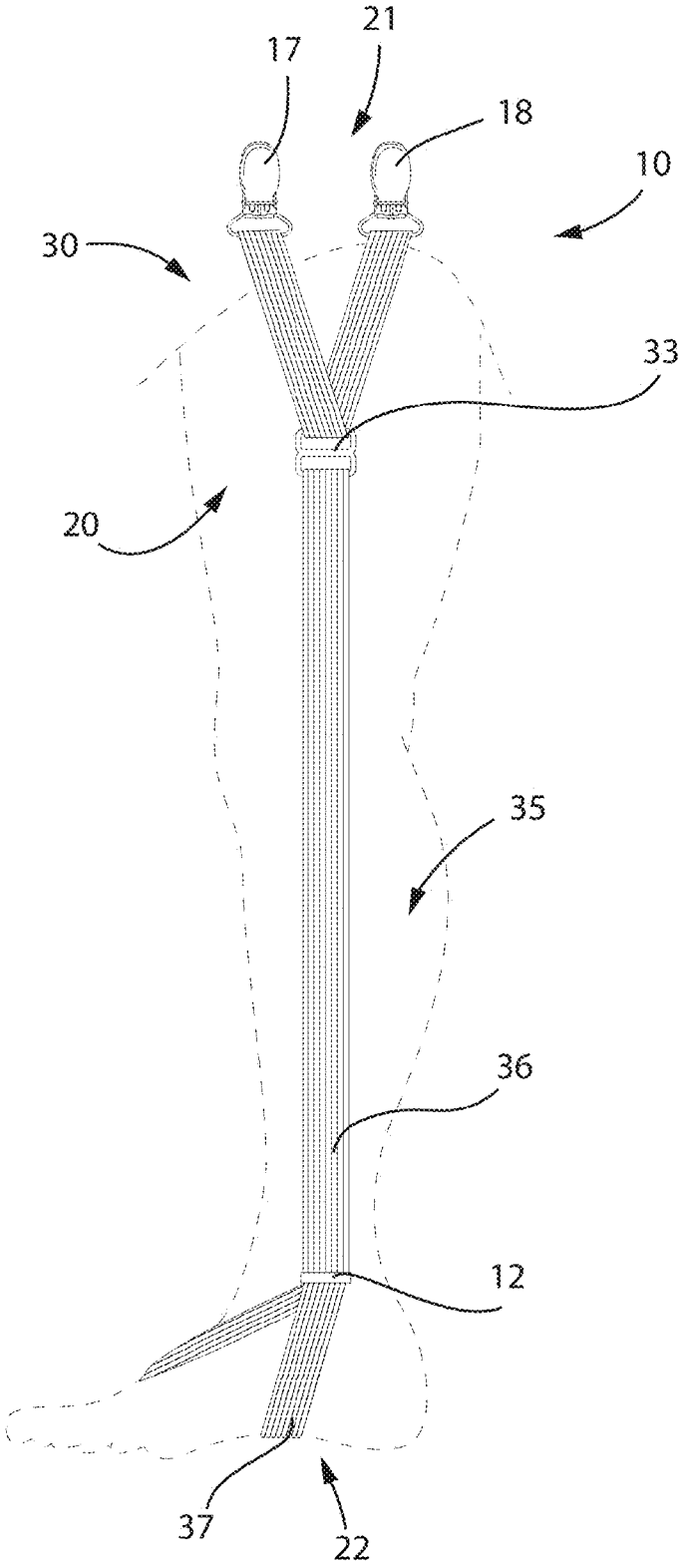
FIG. 2 is a side elevational view of one shirt stay garter of FIG. 1 illustrated in a preferred environment.

Referring to FIGS. 1-2, in a first non-limiting exemplary embodiment of the shirt stay garter 10, the body 20 includes a single and unitary first elastic strap 30 having a first end 31 and a second end 32 juxtaposed adjacent thereto in such a manner that the first end 31 and the second end 32 each are located at the proximal end portion 21 of the body 20. In this manner, the first clip 17 and the second clip 18 are mated to the first end 31 and the second end 32, respectively. A coupling 33 is statically affixed (e.g., sewn) to an intermediary portion 34 of the first elastic strap 30 and equidistantly spaced from the first clip 17 and the second clip 18. A single and unitary second elastic strap 35 slidably engaged with the coupling 33 and located at the distal end portion 22 of the body 20 wherein the second elastic strap 35 is oppositely disposed from the first clip 17 and the second clip 18.

Still referring to FIGS. 1-2, in the first non-limiting exemplary embodiment of the shirt stay garter 10, the first elastic strap 30 has a non-looped configuration. In this manner, the first elastic strap 30 may be removably attached to a shirt tail or the like via clips 17, 18.

Still referring to FIGS. 1-2, in the first non-limiting exemplary embodiment of the shirt stay garter 10, the second elastic strap 35 has a looped configuration including an adjustable first loop 36 and a fixed second loop 37 attached to the adjustable first loop 36. In this manner, the bracket 12 is slidably mated to the adjustable first loop 36 and spaced from the fixed second loop 37 in such a manner that a longitudinal length of the first loop 36 is selectively adjusted at a non-tensioned state (e.g., non-stretched, equilibrium) while a longitudinal length of the second loop 37 remains fixed at a non-tensioned state (e.g., non-stretched, equilibrium), respectively. Of course, the longitudinal length of the first loop 36 can be adjusted at a tensioned state (e.g., when first elastic strap 30 is attached to a shirt tail and second loop 37 is positioned about a user's foot).

Figure 3:
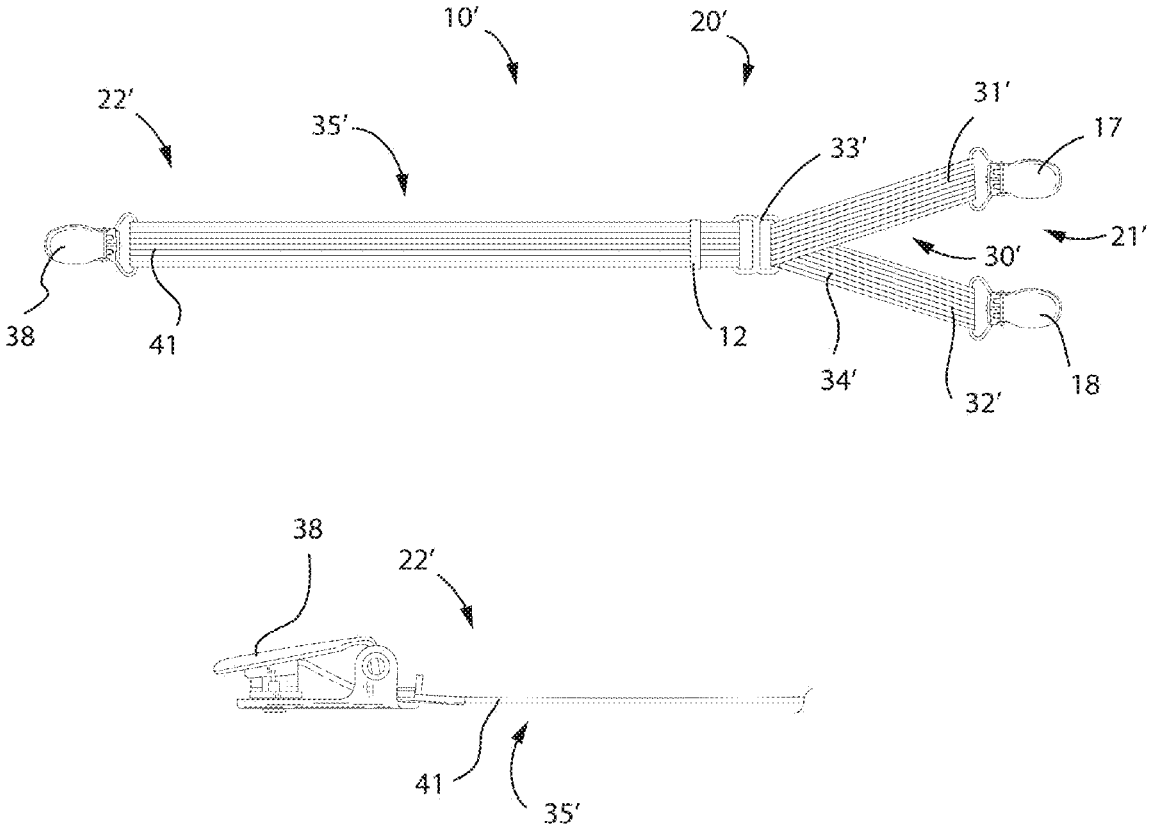
FIG. 3 is a perspective view showing a pair of shirt stay garters, in accordance with a non-limiting exemplary embodiment.
Figure 4:
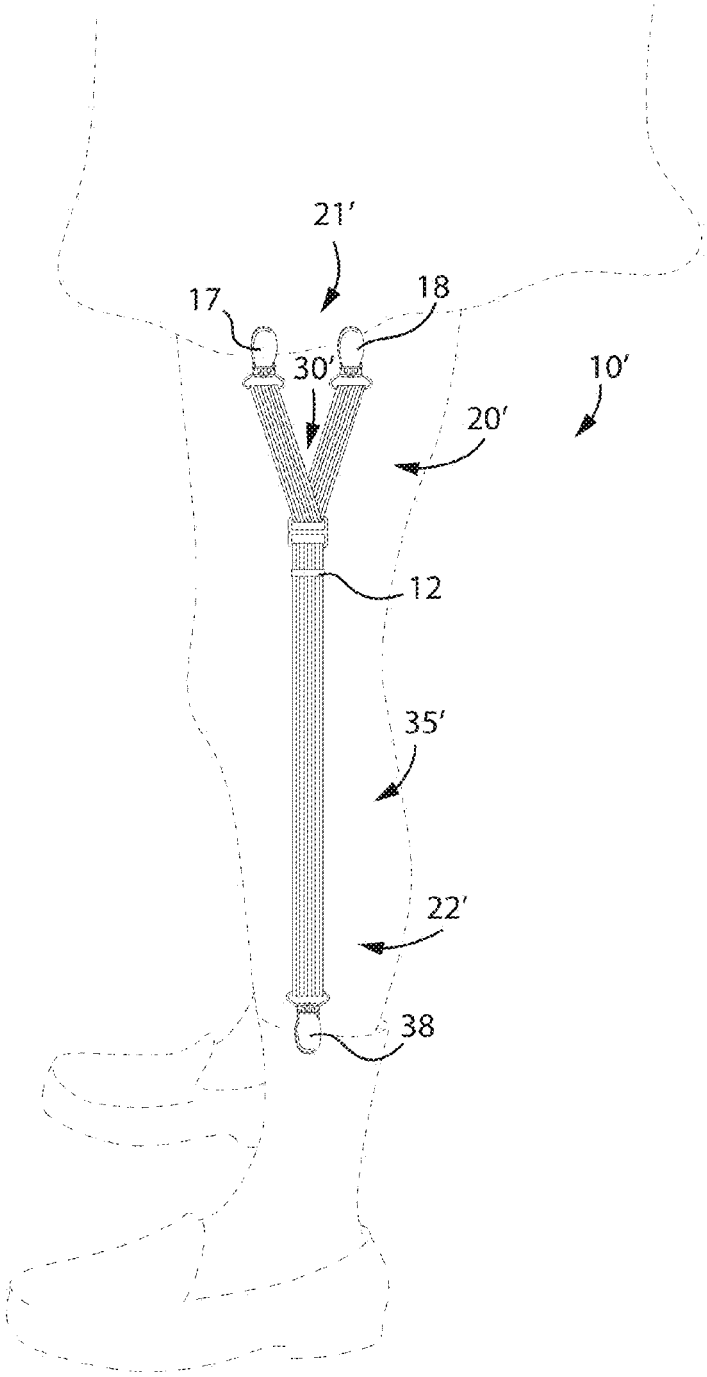
FIG. 4 is a side elevational view of one shirt stay garter of FIG. 3 illustrated in a preferred environment.

Now referring to FIGS. 3-4, in a second non-limiting exemplary embodiment of the shirt stay garter 10', the body 20' includes a single and unitary first elastic strap 30' having a first end 31' and a second end 32' juxtaposed adjacent thereto in such a manner that the first end 31' and the second end 32' are located at the proximal end portion 21' of the body 20' wherein the first clip 17 and the second clip 18 are mated to the first end 31' and the second end 32', respectively. A coupling 33' is statically affixed (e.g., sewn) to an intermediary portion 34' of the first elastic strap 30' and equidistantly spaced from the first clip 17 and the second clip 18. A single and unitary second elastic strap 35' is slidably engaged with the bracket 33' and located at the distal end portion 22' of the body 20' wherein the second elastic strap 35' is oppositely disposed from the first clip 17 and the second clip 18. A third clip 38 is attached to a third end 41 located at the distal end portion 22' of the second elastic strap 35'.

Still referring to FIGS. 3-4, in the second non-limiting exemplary embodiment of the shirt stay garter 10', the second elastic strap 35' has a looped configuration. In this manner, the bracket 12 is slidably mated to the second elastic strap 35' and spaced from the first elastic strap 30' in such a manner that a longitudinal length of the second elastic strap 35' is selectively adjusted at a non-tensioned state (e.g., non-stretched, equilibrium) while a longitudinal length of the first elastic strap 30' is fixed at a non-tensioned state. Of course, the longitudinal length of the first elastic strap 35' can be adjusted at a tensioned state (e.g., when first elastic strap 30' is attached to a shirt tail and second elastic strap 35' is attached to a user's socks).

Still referring to FIGS. 3-4, in the second non-limiting exemplary embodiment of the shirt stay garter 10', a third clip 38 is affixed to the second elastic strap 35' and spaced from the bracket 12. Such a third clip 38 is oppositely spaced from the first clip 17 and the second clip 18.

Figure 5:
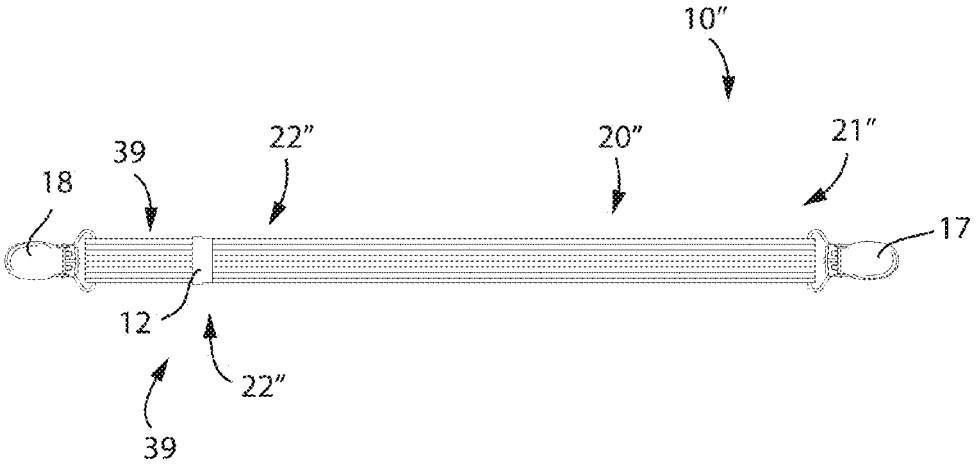
FIG. 5 is a perspective view showing a pair of shirt stay garters, in accordance with a non-limiting exemplary embodiment.
Figure 6:
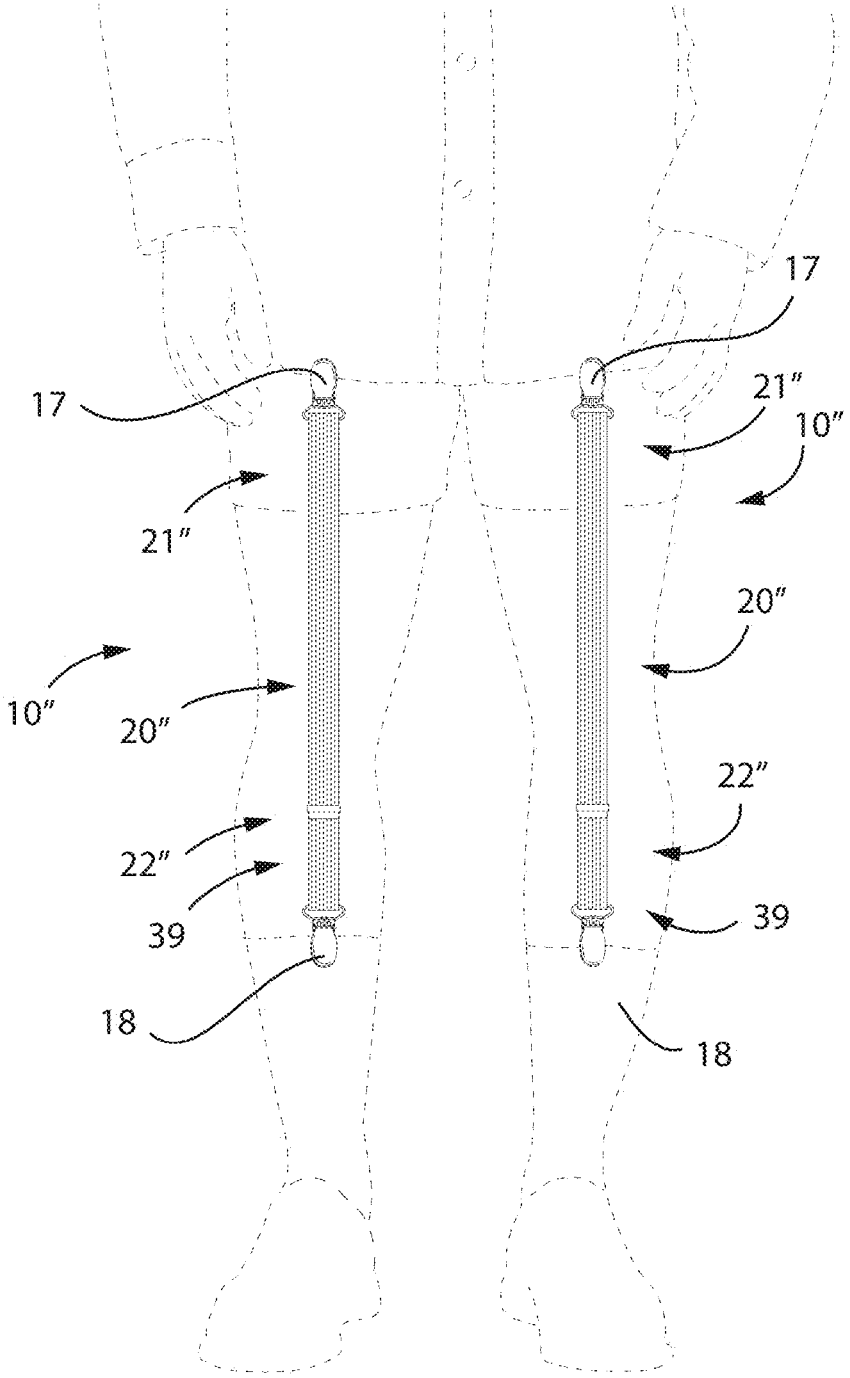
FIG. 6 is a side elevational view of one shirt stay garter of FIG. 5 illustrated in a preferred environment.

Now referring to FIGS. 5-6, in third non-limiting exemplary embodiment of the shirt stay garter 10", the body 20" includes a looped portion 39 located at the distal end portion 22" wherein the first clip 17 is statically affixed to the proximal end portion 21" of the body 20". In this manner, the second clip 18 is slidably connected to the looped portion 39 and oppositely disposed from the first clip 17.

The present disclosure further includes a method of utilizing a shirt stay garter 10, 10', and 10" for maintaining a shirt tail at a tucked position during use. Such a method includes the steps of: providing an elastic body 20, 20' and 20" having a proximal end portion 21, 21' and 21" and a distal end portion 22, 22' and 22" opposed therefrom; providing and pivotally attaching a first clip 17 and a second clip 18 to the body 20, 20' and 20"; providing and slidably engaging a bracket 12 with the body 20, 20' and 20"; spacing the bracket 12 from the first clip 17 and the second clip 18; and selectively adjusting a longitudinal length of the body 20, 20' and 20" by slidably positioning the bracket 12 between the proximal end portion 21, 21' and 21" and the distal end portion 22, 22' and 22" of the body 20, 20' and 20".

Use of the improved fastners (e.g., clips 17, 18 and 38) provides a center pin that keeps the shirt stay device from coming loose. The above-referenced U.S. patents provide a further explanation of such clips 17, 18 and 38. The shirt stay garter may be embodied in a variety of forms including a stirrup style, a 4-strap style, and a Y-style, for example.

The couplings 33, 33' provide enable the proximal end portion 21, 21' to move relative to the distal end portion 22, 22' during walking, running, sitting, etc. conditions. In all embodiments, the shirt stay garter 10, 10' and 10" thus remains connected onto the shirt tail and/or socks thereby providing increased resistance to external forces acting against the proximal and distal members 21, 21' and 22, 22', respectively. In this manner, the shirt stay garter 10, 10' and 10" is less likely to detach from the shirt tail and maintains direct engagement therewith during extended periods of time.

In a non-limiting exemplary embodiment, the clips 17, 18 and 38 may be a suspender clip only without the pin.

Figure 7:
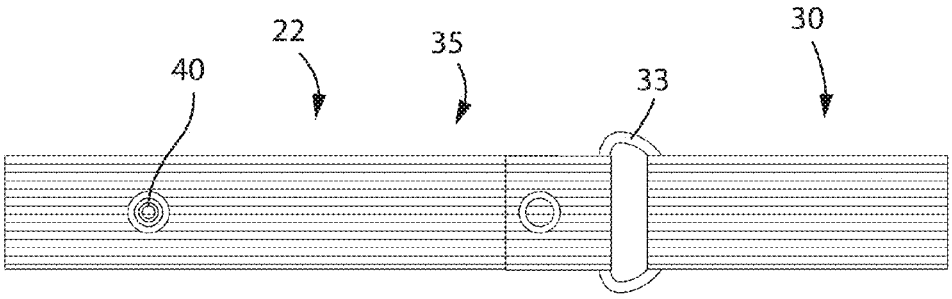
FIG. 7 is an enlarged top plan view illustrating a portion of shirt stay garter employing an alternate length-adjusting member.
Figure 8:
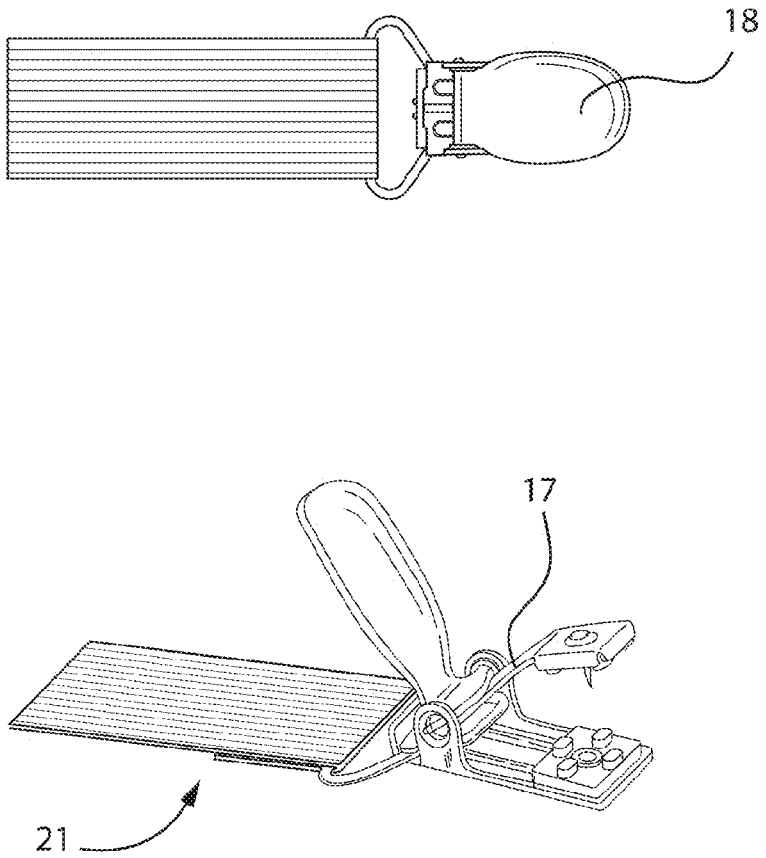
FIG. 8 is an enlarged perspective view illustrating the interrelationship between the components of clip.

In a non-limiting exemplary embodiment, as shown in FIG. 7, a snap button 40 in lieu of or in combination with bracket 12 may be employed to adjust a length of the shirt stay garter 10, 10' and 10", as opposed to employing bracket 12, which may not hold its place in adjustment when used with elastic strapping during running, etc.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A shirt stay garter for maintaining a shirt tail at a tucked position during use, said shirt stay garter including:

A body having a proximal end portion and a distal end portion opposed therefrom;

a first clip and a second clip attached to said body;

a bracket slidably spaced from said first clip and said second clip, said bracket being engaged with said body in such a manner that a longitudinal length of said body is selectively adjusted as said bracket is slidably positioned between said proximal end portion and said distal end portion of said body; wherein said body comprises: a single and unitary first elastic strap having a first end and a second end juxtaposed adjacent thereto in such a manner that said first end and said second end each are located at said proximal end portion of said body, said first clip and said second clip being mated to said first end and said second end, respectively;

a coupling statically affixed to an intermediary portion of said first elastic strap and equidistantly spaced from said first clip and said second clip; and a single and unitary second elastic strap slidably engaged with said coupling and located at said distal end portion of said body, said second elastic strap being oppositely disposed from said first clip and said second clip.

2. The shirt stay garter of claim 1, wherein said first elastic strap has a non-looped configuration.

3. The shirt stay garter of claim 2, wherein said second elastic strap has a looped configuration including an adjustable first loop and a fixed second loop attached to said adjustable first loop, said bracket being slidably mated to said adjustable first loop and spaced from said fixed second loop in such a manner that a longitudinal length of said first loop is selectively adjusted at a non-tensioned state while a longitudinal length of said second loop remains fixed at a non-tensioned state, respectively.

4. The shirt stay garter of claim 3, further comprising: a third clip affixed to said second elastic strap and spaced from said bracket, said third clip being oppositely spaced from said first clip and said second clip.

5. The shirt stay garter of claim 1, wherein said body comprises: a looped portion located at said distal end portion, said first clip being statically affixed to said proximal end portion of said body, said second clip being slidably connected to said looped portion and oppositely disposed from said first clip.

6. A shirt stay garter for maintaining a shirt tail at a tucked position during use, said shirt stay garter including:

an elastic body having a proximal end portion and a distal end portion opposed therefrom;

a first clip and a second clip pivotally attached to said body;

a bracket slidably spaced from said first clip and said second clip, said bracket being engaged with said body in such a manner that a longitudinal length of said body is selectively adjusted as said bracket is slidably positioned between said proximal end portion and said distal end portion of said body; wherein said body comprises: a single and unitary first elastic strap having a first end and a second end juxtaposed adjacent thereto in such a manner that said first end and said second end each are located at said proximal end portion of said body, said first clip and said second clip being mated to said first end and said second end, respectively;

a coupling statically affixed to an intermediary portion of said first elastic strap and equidistantly spaced from said first clip and said second clip; and a single and unitary second elastic strap slidably engaged with said coupling and located at said distal end portion of said body, said second elastic strap being oppositely disposed from said first clip and said second clip.

7. The shirt stay garter of claim 6, wherein said first elastic strap has a non-looped configuration.

8. The shirt stay garter of claim 7, wherein said second elastic strap has a looped configuration including an adjustable first loop and a fixed second loop attached to said adjustable first loop, said bracket being slidably mated to said adjustable first loop and spaced from said fixed second loop in such a manner that a longitudinal length of said second loop is selectively adjusted at a non-tensioned state while a longitudinal length of said first elastic strap remains fixed at a non-tensioned state, respectively.

9. The shirt stay garter of claim 8, further comprising: a third clip affixed to said second elastic strap and spaced from said bracket, said third clip being oppositely spaced from said first clip and said second clip.

10. The shirt stay garter of claim 9, wherein said body comprises: a looped portion located at said distal end portion, said first clip being statically affixed to said proximal end portion of said body, said second clip being slidably connected to said looped portion and oppositely disposed from said first clip.

11. A method of utilizing a shirt stay garter for maintaining a shirt tail at a tucked position during use, said method including the steps of:

providing an elastic body having a first clip and a second clip attached to said body; a bracket slidably spaced from said first clip and said second clip, said bracket being engaged with said body in such a manner that a longitudinal length of said body is selectively adjusted as said bracket is slidably positioned between said proximal end portion and said distal end portion of said body; wherein said body comprises: a single and unitary first elastic strap having a first end and a second end juxtaposed adjacent thereto in such a manner that said first end and said second end each are located at said proximal end portion of said body, said first clip and said second clip being mated to said first end and said second end, respectively;

a coupling statically affixed to an intermediary portion of said first elastic strap and equidistantly spaced from said first clip and said second clip; and a single and unitary second elastic strap slidably engaged with said coupling and located at said distal end portion of said body, said second elastic strap being oppositely disposed from said first clip and said second clip a proximal end portion and a distal end portion opposed therefrom;

providing and pivotally attaching a first clip and a second clip to said body;

providing and slidably engaging a bracket with said body;

spacing said bracket from said first clip and said second clip; and selectively adjusting a longitudinal length of said body by slidably positioning said bracket between said proximal end portion and said distal end portion of said body.

* * * * *